US008663458B2

(12) United States Patent
Smith, Jr.

(10) Patent No.: US 8,663,458 B2
(45) Date of Patent: Mar. 4, 2014

(54) PROCESS TO HYDRODESULFURIZE PYROLYSIS GASOLINE

(75) Inventor: Lawrence A. Smith, Jr., Houston, TX (US)

(73) Assignee: Chemical Process and Production, Inc, Arcadia, TX (US)

( * ) Notice: Subject to any disclaimer, the term of this patent is extended or adjusted under 35 U.S.C. 154(b) by 268 days.

(21) Appl. No.: 12/931,521

(22) Filed: Feb. 3, 2011

(65) Prior Publication Data

US 2012/0203039 A1 Aug. 9, 2012

(51) Int. Cl.
*C10G 45/00* (2006.01)

(52) U.S. Cl.
USPC ..... 208/210; 208/208 R; 208/209

(58) Field of Classification Search
USPC ..... 585/14
See application file for complete search history.

(56) References Cited

U.S. PATENT DOCUMENTS

| | | | | |
|---|---|---|---|---|
| 3,812,057 | A * | 5/1974 | Morgan | 502/50 |
| 3,923,921 | A | 12/1975 | Kohfeldt | |
| 4,097,370 | A | 6/1978 | Minkkinen | |
| 4,173,529 | A | 11/1979 | Bauer | |
| 4,397,739 | A * | 8/1983 | Jacquin et al. | 208/210 |
| 5,510,016 | A | 4/1996 | Hilbert et al. | |
| 6,090,270 | A * | 7/2000 | Gildert | 208/57 |
| 7,014,750 | B2 | 3/2006 | Boget et al. | |
| 7,674,366 | B2 | 3/2010 | Strack et al. | |
| 7,749,372 | B2 | 7/2010 | Strack et al. | |
| 2003/0205504 | A1 * | 11/2003 | Kaminsky et al. | 208/210 |
| 2005/0098479 | A1 * | 5/2005 | Jacobs et al. | 208/211 |
| 2009/0183981 | A1 | 7/2009 | Podrebarac et al. | |
| 2010/0288679 | A1 * | 11/2010 | Himelfarb | 208/48 R |

OTHER PUBLICATIONS

Robinson, Ken K. "Reactor Engineering." (2006) pp. 2557-2583.*

* cited by examiner

*Primary Examiner* — Randy Boyer
*Assistant Examiner* — Juan Valencia
(74) *Attorney, Agent, or Firm* — Kenneth H Johnson

(57) ABSTRACT

A single stage process for treating pyrolysis gasoline containing acetylene, diolefins, sulfur compounds and nitrogen compounds to react a sufficient amount of said acetylene and diolefins with hydrogen to produce saturated products and hydrogen sulfide to provide a pyrolysis gasoline product suitably for use as gasoline blending stock comprising: feeding pyrolysis gasoline and hydrogen at a mol ratio of hydrogen to pyrolysis gasoline of at least 0.5:1 and preferably in the range of 1:1 to 3:1 to a hydrodesulfurization zone containing a hydrodesulfurization catalyst such as cobalt/molybdenum under vapor phase conditions at a pressure in the range of 200 to 500 psig at a temperature in the range of 550° F. to 850° F. The operating temperature is at least above the dew point of the mixture of pyrolysis gasoline and hydrogen, preferably in a range 50 to 400° F. above said dew point.

10 Claims, 1 Drawing Sheet

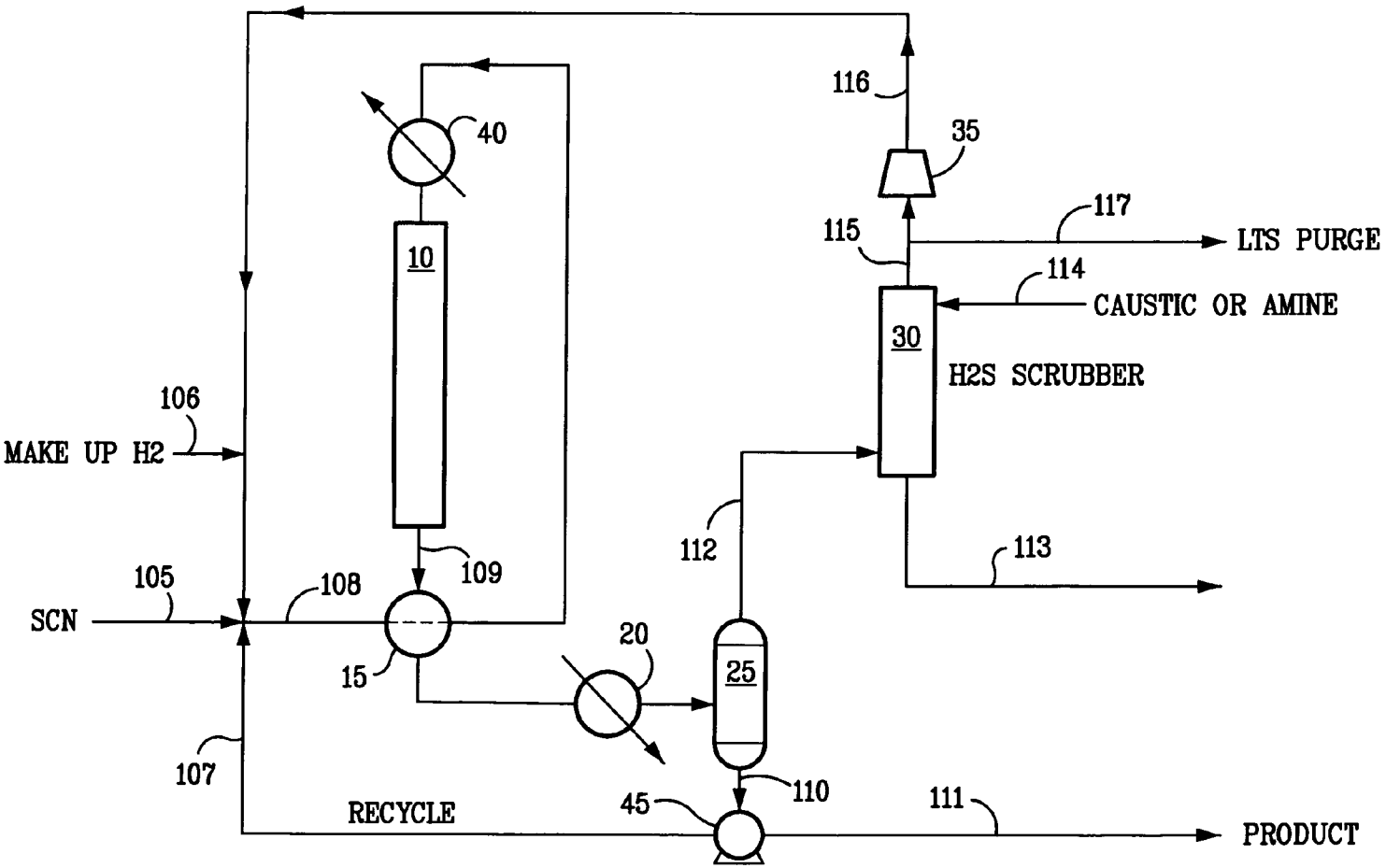
LTS PURGE
CAUSTIC OR AMINE
H2S SCRUBBER
PRODUCT
RECYCLE
MAKE UP H2
SCN
10
15
20
25
30
35
40
45
105
106
107
108
109
110
111
112
113
114
115
116
117

PROCESS TO HYDRODESULFURIZE PYROLYSIS GASOLINE

BACKGROUND OF THE INVENTION

1. Field of the Invention

The present invention relates to a process for the processing of pyrolysis gasoline. More particularly the invention relates to a single stage process for treating the pyrolysis gasoline to remove or convert unwanted contaminants to provide a commercially attractive product.

2. Related Art

Pyrolysis gasoline is a gasoline boiling range petroleum stock obtained as a product or by-product from a process in which thermal processing is used to crack a petroleum stock. One example is the destructive cracking of a naphtha boiling range material to produce ethylene. Another example is the delayed coking of a residual petroleum stock to produce lighter components, including coker gasoline. Products from these thermal cracking processes contain high concentrations of olefinic materials as well as saturated (alkanes) materials and polyunsaturated materials (diolefins). The components of the thermal cracking may be any of the various isomers of these compounds. In addition the gasoline boiling range material contains considerable amounts of aromatic compounds and heteroatom compositions such as nitrogen and sulfur containing compounds.

The pyrolysis gasolines are typically processed to removed unwanted acetylenes, diolefins and sulfur compounds. Some of the diolefins may be recovered, especially isoprene. Starting with the product coming from a steam cracker, the valuable $C_2$ $C_3$ and $C_4$ olefins (and in some cases diolefins) are recovered. This leaves a $C_{5+}$ fraction. Usually the $C_5$ fraction is isolated and hydrogenated in a fixed bed reactor. In some cases isoprene is recovered from this fraction. The remaining $C_{6+}$ faction is then distilled to isolate a $C_6$-450° F. material suitable for gasoline blending. This fraction, is the pyrolysis gasoline also called "pygas" which must be hydrotreated in order to be blended into gasoline.

Pygas is not stable, and in the prior art treated in a two-stage reactor configuration. The first stage rector is commonly loaded with a Pd or Ni catalyst and operated at moderate temperatures in order to remove very reactive components. Such components include acetylenes, dienes, cyclodienes, styrene and styrenic (alkenyl benzene) compounds. Typically styrene and styrenic levels in the gasoline to the first stage hydrotreater are in the 2 to 8 wt. % range, more typically 2 to 4 wt. %. Sulphur levels are typically in the 100 to 1000 wt. ppm, more typically 100 to 400 ppm. Although the pyrolysis gasoline produced from a first stage hydrotreater is sufficiently stable for gasoline blending, the material often cannot be used because of the sulfur concentration is too high to meet very low sulfur concentration now required in the gasoline pool. To meet sulfur regulations, the product from the first stage is sent to a second stage with CoMo and/or NiMo catalysts to remove S. Following the second stage, it is fairly common that there is further distillation of the pygas to isolate a C6 fraction for benzene extraction, or perhaps even a C7-C9 faction for toluene/xylenes extraction. Thus, it is not important to preserve olefin groups in the second stage, but it is important that aromatics saturation is minimized.

The $C_5$'s may be recovered and are useful in isomerization, etherification and alkylation. As noted above, isoprene may also be recovered as a useful product. Normally, however, the diolefins are removed along with acetylenes by selective hydrogenation. The $C_5$'s may be completely hydrogenated and returned to a naphtha cracker ethylene plant as recycle.

The $C_6$ and heavier fractions contain sulfur compounds which are usually removed by hydrodesulfurization. The aromatic compounds are often removed and purified by distillation to produce benzene, toluene and xylenes. The aromatic containing fraction is often treated with clay material to remove olefinic material.

Finally the heavy boiling gasoline is normally treated with caustic to remove the mercaptans and olefins prior to being used as a gasoline blending stock. In the present invention many of the separate steps and processes of the prior art are combined into a single multifunctional stage.

A common problem with prior two-stage pygas processes is short run life due to the highly reactive nature of the species in the pygas (even after first stage treatment). Unconverted styrenic compounds and dienes tend to lead to polymer formation and fouling when exposed to the higher temperatures of the second stage. This causes fouling in heaters and high pressure drop across the catalyst bed. It is an advantage of the present invention that a single stage process is provided which avoids fouling and plugging problems, exhibits improved run length in pygas units to increase conversion of styrenics and dienes with nearly full octane retention.

SUMMARY OF THE INVENTION

In a broad aspect the present invention is a process for producing pyrolysis gasoline having reduced acetylene and sulfur content for use as automotive blending stock comprising feeding hydrogen and thermally cracked petroleum stock pyrolysis gasoline containing acetylene, diolefins, sulfur compounds and nitrogen compounds to as single stage hydrodesulfurization zone containing a hydrodesulfurization catalyst under conditions of temperature and pressure to provide a completely vapor phase reaction mixture of said hydrogen and pyrolysis gasoline having a mol ratio of hydrogen to pyrolysis gasoline of at least 0.5:1 to 3:1 wherein a portion of said acetylene and diolefins are reacted with hydrogen to produce saturated products and a portion of said sulfur compounds react with hydrogen to produce hydrogen sulfide.

A particular embodiment is a process for producing pyrolysis gasoline having reduced acetylene and sulfur content for use as automotive blending stock comprising feeding hydrogen and prefractionated thermally cracked petroleum stock pyrolysis gasoline boiling in the range of about $C_6$-450° F. containing acetylene, diolefins, sulfur compounds and nitrogen compounds to a single stage hydrodesulfurization zone containing a hydrodesulfurization catalyst under conditions of temperature and pressure to provide a completely vapor phase reaction mixture of said hydrogen and pyrolysis gasoline having a mol ratio of hydrogen to pyrolysis gasoline of at least 0.5:1 to 3:1 wherein a portion of said acetylene and diolefins are reacted with hydrogen to produce saturated products and a portion of said sulfur compounds react with hydrogen to produce hydrogen sulfide.

In a particular embodiment the present invention is a process for treating pyrolysis gasoline containing acetylene, diolefins, sulfur compounds and nitrogen compounds in a single stage comprising: feeding pyrolysis gasoline and hydrogen to a hydrodesulfurization zone containing a hydrodesulfurization catalyst under vapor phase conditions at a pressure in the range of 200 to 500 psig at a mol ratio of hydrogen to pyrolysis gasoline of at least 0.5:1 and preferably in the range of 1:1 to 3:1 to form a mixture of pyrolysis gasoline and hydrogen wherein a portion of said acetylene and diolefins are reacted with hydrogen to produce saturated products and a portion of said sulfur compounds react with hydrogen to produce hydrogen sulfide. Preferably the temperature in the hydrodesulfurization zone is at least above the dew point of the mixture of pyrolysis gasoline and hydrogen, preferably in a range 50 to 400° F. above said dew point. Preferably the operating temperature in the hydrodesulfurization zone is in the range of 550° F. to 850° F.

To recover the treated pyrolysis gasoline, the effluent from the hydrogenation zone is recovered, partially condensed to form a mixture comprising a liquid portion recovered as product and a $H_2S$ containing vapor portion remove for further treatment.

In a particular embodiment the feed to the present process comprises a crude steam cracked naphtha (SCN). In a preferred embodiment the feed to the reaction zone comprises a prefractionated thermally cracked petroleum stock (which may be characterized as $C_2$-450° F. pyrolysis gasoline) fractionated to produce a pyrolysis gasoline boiling in the range of about $C_6$-450° F.

In a preferred embodiment the reaction zone comprises a downflow reactor, more preferably using a cobalt/molybdenum hydrodesulfurization catalyst.

BRIEF DESCRIPTION OF THE DRAWING

The FIGURE is a flow diagram in schematic form of one embodiment of the present invention.

DESCRIPTION OF THE PREFERRED EMBODIMENTS

Typically hydrodesulfurization of pyrolysis gasoline is accomplished in two stages. The first stage hydrogenates styrenics and diolefins at lower temperatures to reduce fouling tendencies. Then a second reactor is employed under more severe conditions for hydrodesulfurization. The first stage hydrogenates styrenics and diolefins at lower temperatures to reduce fouling tendencies. Then a second reactor is employed under more severe conditions for hydrodesulfurization. Although Pygas is notoriously difficult to process without fouling, gumming and/or coking, it was found that the first stage reactor can be eliminated by running a single reactor under vapor phase conditions with a higher ratio of hydrogen to the pygas, than used heretofore. It is proposed that the higher ratio of hydrogen acts to "hydrogen strip" coke before it builds up in the reaction zone. This is a proposed mechanism for the observed effect and is not intended to limit the scope of the invention.

Since the present process operates in total vapor phase, it is readily distinguished from those prior art procedure which have substantial flowing liquid phase such as substantially liquid phase trickle bed or of a quasi distillation having a downward flow of the internal reflux which continuously washes the catalyst.

The catalytic material is preferably conventional packed bed catalyst particles or structures. The reaction system can be described as heterogenous, since the catalyst remains a distinct entity. The particulate catalyst material may be small irregular chunks or fragments, small beads and the like. The particular form of the catalytic material in the structure is not critical so long as sufficient surface area is provided to allow a reasonable reaction rate. The sizing of catalyst particles can be best determined for each catalytic material (since the porosity or available internal surface area will vary for different material and, of course, affect the activity of the catalytic material). The reaction system can be described as heterogenous, since the catalyst remains a distinct entity.

As defined herein hydrotreating is considered to be a process wherein hydrogen is utilized to remove unwanted contaminants by 1) selective hydrogenation, 2) destructive hydrodesulfurization or 3) mercaptan-diolefin addition in the presence of hydrogen.

Catalysts preferred for the reactions note herein include Group VIII metals such as cobalt, nickel, palladium, alone or in combination with other metals such as molybdenum or tungsten on a suitable support which may be alumina, silica-alumina, titania-zirconia or the like as well known and used in the art. Generally the metals are deposited as the oxides on extrudates or spheres, typically alumina.

Referring now to the FIGURE which is a simplified flow diagram of a preferred embodiment. The feed comprises pyrolysis gasoline which is a complex mixture of predominately hydrocarbon paraffins, naphthenics, acetylenes, dienes, cyclodienes and styrenic compounds (alkynyl benzenes) and other aromatics boiling in the range of about 97 to 450° F. Typical pyrolysis gasolines may contain: 4-30% aromatics (2-8% styrene and styrenics), 10-30% olefins, 35-72% paraffins and 1-20% unsaturated containing trace amounts of sulfur (rom 100 to 100 wppm), oxygen and/or nitrogen organic compounds. The hydrocarbons are principally $C_4$-$C_9$ alkanes, olefins, diolefins, acetylenes, benzene, toluene, xylenes, organic compounds of sulfur and nitrogen and some heavier residuum.

In this embodiment the crude pyrolysis gasoline is fractionated to remove $C_5$'s and lighter material and produce a $C_6$ to 450° F. boiling material which is fed via flow line 105 and combined with hydrogen from flow line 106 and recycle from the reaction in line 107. The combined feed is fed via flow line 108 to the reactor 10 after passing through heat exchanger 15 to recover heat from reactor 10 and cool the reaction product leaving reactor 10 via flow line 109. The feed in flow line 108 passes through heat exchanger 40 where it is heated to the desired entry temperature and hence into reactor 10. The reactor 10 is a standard fixed bed trickle flow type reactor containing a hydrogenation catalyst (not shown) which is supported Co/Mo.

The effluent from the reactor 10 including unreacted hydrogen, is taken via flow line 109 though cooler 20 and into separator 25 where a liquid bottoms is recovered in flow line 110 and split into two streams. The first stream, a recycle stream, is recycled to feed flow line 105 via flow line 107. The product pygas blending stock is recovered via flow line 111.

A gaseous overhead is recovered from separator 25 via flow line 112, which is fed to an $H_2S$ scrubber 30 where the vapor is contact in suitable dispersing structure, such as demister wire with a caustic or amine, for example, via flow line 114 to strip out the $H_2S$ which is removed via flow line 113. A lights purge is recovered from scrubber 30 as via line 117 from overheads in flow line 115 which are returned to the hydrogen feed 106 through compressor 35 and flow line 116.

EXAMPLE

An embodiment of the invention is described in the following example. Crude Steam Cracked Naphtha (SCN) is first separated by distillation with about 70% being recovered overhead which is in the gasoline boiling range. This overhead is referred to herein as "Pygas" and becomes the feedstock for the present hydrodesulfurization (HDS). Aside from producing a gasoline boiling range, the fractionation has the additional beneficial effect of partially reducing Total Sulfur (TS) and Total Nitrogen (TN) as the following example shows:

TABLE

| | TS ppm | TN ppm |
|---|---|---|
| Crude SCN feed to fractionation | 4235 | 95 |
| Overhead Pygas | 2770 | 37 |

The Pygas produced by fractionation is then subjected to vapor phase (or nearly so) HDS conditions in a single reactor with both hydrogen and product recycles. The results are shown in the following example:

Catalyst=Unicat HT-85-S (presulfided Co/Moly 1.6 mm extrudates)

Pressure=400 psig

LHSV (feed Hydrocarbon [HC])=1.79

LHSV (feed HC+recycle HC)=7.14

H2 (fresh H2+recycle H2)=8489 Scf/bbl feed HC

H2 (fresh H2+recycle H2)=2122 Scf/bbl feed HC+recycle HC

Cal. dewpoint of reactor mixture=458° F. at 400 psig

Temp In=671 F

Temp Out=773 F

| Analysis: | Feed Pygas | Product |
|---|---|---|
| TN ppm | 37 | 10 |
| TS ppm | 2770 | 16 |
| RON | 98.0 | 97.2 |
| MON | 84.7 | 84.5 |
| (R + M)/2 | 91.4 | 90.6 |
| Bromine No. | 75 | <5 |
| Gum | — | 0.5 |

Surprisingly the Bromine number (indication of olefinic materials) was substantially lowered without significantly reducing the motor octane. This result may be partially explained by the production of ethyl benzene from styrene. The reduction of styrenics and other diolefins by hydrogenation would appear to be responsible for the very low gum product.

Hot spots and runaway reactions are avoided by recycling part of the product to limit the exotherm across the reactor. Unexpectedly, the reactor size need not be substantially increased, even with recycling both product and a high ratio of hydrogen. This may be explained in part by the observation that the pressure drop dramatically decreases going from a two phase trickle bed operation to all vapor phase, thus allowing higher throughput. Also, higher velocity circulation of hydrogen rich vapor was observed to improve both heat and mass transfer.

The result is that a reactor sized for about 40 minutes liquid feed residence time (1.5 LHSV) can effectively hydrodesulfurize Pygas under hydrogen rich vapor phase conditions in less than 15 seconds residence time.

The invention claimed is:

1. A process for producing pyrolysis gasoline having reduced acetylene and sulfur content for use as automotive blending stock comprising feeding hydrogen and prefractionated thermally cracked petroleum stock pyrolysis gasoline boiling in the range of about $C_6$-450° F. containing acetylene, diolefins, sulfur compounds and nitrogen compounds to as single stage hydrodesulfurization zone containing a hydrodesulfurization catalyst under conditions of temperature and pressure to provide a completely vapor phase reaction mixture of said hydrogen and pyrolysis gasoline mixture in the range of 550° F. to 850F.° having a mol ratio of hydrogen to pyrolysis gasoline of 0.5:1 to 3:1 wherein a portion of said acetylene and diolefins are reacted with hydrogen to produce saturated products and a portion of said sulfur compounds react with hydrogen to produce hydrogen sulfide, wherein pyrolysis gasoline is recovered from said hydrodesulfurization zone and a portion condensed, wherein the condensed portion is separated into two fractions, wherein a first fraction is recovered as a product and a second fraction is recycled to said hydrodesulfurization zone.

2. The process according to claim 1, wherein the hydrodesulfurization catalyst comprises a cobalt/molybdenum hydrodesulfurization catalyst.

3. A process according to claim 1, carried out in a single stage reactor.

4. The process according to claim 3, wherein said pyrolysis gasoline is characterized as $C_2$-450° F. pyrolysis gasoline.

5. The process according to claim 3, wherein said mol ratio is in the range of 1:1 to 3:1.

6. The process according claim 3, wherein the temperature in the hydrodesulfurization zone is at least above the dew point of the mixture of pyrolysis gasoline and hydrogen.

7. The process according to claim 6, wherein the temperature in the hydrodesulfurization zone is in a range 50 to 400° F. above said dew point.

8. The process according to claim 3, wherein the pyrolysis gasoline boiling in the range of about $C_6$-450° F. is an overhead product.

9. The process according to claim 3, wherein the reaction zone comprises a downflow reactor.

10. The process according to claim 3, wherein the hydrodesulfurization catalyst comprises a cobalt/molybdenum hydrodesulfurization catalyst.

* * * * *